US006841978B2

(12) United States Patent
Schaffer

(10) Patent No.: US 6,841,978 B2
(45) Date of Patent: Jan. 11, 2005

(54) VOLTAGE REGULATOR WITH FREQUENCY RESPONSE CORRECTION

(75) Inventor: Bernhard Schaffer, Villach (AT)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 10/765,620

(22) Filed: Jan. 27, 2004

(65) Prior Publication Data

US 2004/0207374 A1 Oct. 21, 2004

Related U.S. Application Data

(63) Continuation of application No. PCT/DE02/02449, filed on Aug. 4, 2002.

(30) Foreign Application Priority Data

Jul. 27, 2001 (DE) ..... 101 36 715
Oct. 10, 2001 (DE) ..... 101 49 907

(51) Int. Cl.[7] ..... G05F 1/56
(52) U.S. Cl. ..... 323/280
(58) Field of Search ..... 323/273, 274, 323/280, 281

(56) References Cited

U.S. PATENT DOCUMENTS 4,908,566 A 3/1990 Tesch ..... 323/280
5,191,278 A 3/1993 Carpenter ..... 323/275
5,631,598 A * 5/1997 Miranda et al. ..... 327/540
5,852,359 A * 12/1998 Callahan et al. ..... 323/274
5,889,393 A 3/1999 Wrathall ..... 323/282
6,465,994 B1 * 10/2002 Xi ..... 323/274
6,518,737 B1 * 2/2003 Stanescu et al. ..... 323/280
6,630,903 B1 * 10/2003 Hann et al. ..... 342/175

FOREIGN PATENT DOCUMENTS

EP 0 766 164 A2 4/1997 ..... G05F/3/26
EP 0 846 996 A1 6/1998 ..... G05F/1/575

OTHER PUBLICATIONS

G.A. Rincon–Mora et al.; "Optimized Frequency–Shaping Circuit Topologies for LDO's"; IEEE Transactions on Circuits nad Systems II; vol. 45; No. 6, pps. 703–708, 1998.
R. Funke et al.; "Grundschaltungen der Elektonik" (Basic circuits of Electronics); Verlag Technik, Berlin, pp. 24–34, 1983.
H. Lindner et al.; "Elektrotechnik—Elektronik" (Electrical engineering—electonics); Fachbuchverlag Leipzig, pps. 591–606, 1983.

* cited by examiner

*Primary Examiner*—Adolf Berhane
(74) *Attorney, Agent, or Firm*—Baker Botts L.L.P.

(57) ABSTRACT

A voltage regulator has a voltage regulator output (6) for providing a regulated output voltage (Uout) and an internal nonreactive resistor (RZ) arranged in series with an external load (RL) to be connected to the voltage regulator output (6). An internal electrical regulation feedback path of the voltage regulator (10, 11) is tapped both at a first point (A) upstream of the internal nonreactive resistor (RZ) and at a second point (B) downstream of the internal nonreactive resistor (RZ), the second point (B) being located between the internal nonreactive resistor (RZ) and the voltage regulator output (6). For frequencies above a predetermined frequency (fw), the regulation is essentially effective directly via the first point (A) and not via the second point (B), while for frequencies below the predetermined frequency (fw), the regulation is essentially effected via the path first point (A)-internal nonreactive resistor (RZ)-second point (B).

15 Claims, 6 Drawing Sheets

VOLTAGE REGULATOR WITH FREQUENCY RESPONSE CORRECTION

CROSS REFERENCE TO RELATED APPLICATION

This application is a continuation of copending International Application No. PCT/DE02/02449 filed Jul. 4, 2002 which designates the United States, and claims priority to German applications no. 101 36 715.5 filed Jul. 27, 2001 and no. 101 49 907.8 filed Oct. 10, 2001.

TECHNICAL FIELD OF THE INVENTION

The present invention relates to a voltage regulator.

DESCRIPTION OF THE RELATED ART

Electronic systems on silicon often require the provision of operating voltage of different magnitudes (IO region, digital core and analog circuits).

If an operating voltage having a lower level is to be generated from a given supply voltage, discrete voltage regulators are used as additional components. These are not always desirable owing to high costs and additional control lines, but can be integrated in a cost-saving manner beside the system on silicon.

Voltage regulators as such are known in the prior art and described e.g. in Funke, R.; Liebscher, S.: "Grundschaltungen der Elektronik" [Basic circuits of electronics], Verlag Technik, Berlin 1983, pp. 24 to 34, or in Lindner, H.; Brauer, H.; Lehmann, C.: "Elektrotechnik-Elektronik" [Electrical engineering-electronics], Fachbuchverlag Leipzig 1983, pp. 591 to 605. Furthermore, reference shall expressly be made at this point, in particular with regard to questions of mathematical-physical details of voltage regulating technology, to the article "Optimized Frequency-Shaping Circuit Topologies for LDO's" by G. A. Rincon-Mora and P. E. Allen in IEEE TRANSACTIONS ON CIRCUITS AND SYSTEMS-II: ANALOG AND DIGITAL SIGNAL PROCESSING, Vol. 45 (1998), No. 6, pp. 703 to 708.

However, the realization of integrated voltage regulators is not trivial on account of stability problems. The same technical stability problem furthermore also occurs in discrete voltage regulator modules.

The stability problems just mentioned will be briefly explained below. Reference is made to FIG. 2, which generally shows a diagram of a voltage regulator 12 known from the prior art. In general, the following components are found in voltage regulating circuits: a reference voltage Uref, a regulating amplifier 1, e.g. formed as an operational amplifier, a regulating transistor Q, which may be e.g. a FET or a bipolar transistor, the regulating transistor Q being portrayed as a controlled current source in FIG. 2. Furthermore, a general voltage regulating circuit includes a load, which, in accordance with FIG. 2, comprises a load resistor RL, an external buffer capacitance CL and, at least in certain cases, an internal voltage divider R1, R2. The buffer capacitance CL may also be a purely parasitic capacitance.

The DC voltage gain of an open regulating loop in the small-signal range is composed of a plurality of factors. The DC voltage gain of the regulating amplifier 1 lies in the range of between 40 and 60 dB. This magnitude results from the requirements made of the static regulating deviation. In conjunction with the load resistor RL and the voltage divider R1, R2, the regulating transistor Q makes a contribution to the gain in the range of between 0 and 30 dB, to be precise in a manner dependent on the transistor Q used, the nonreactive load resistor RL and the supply voltage.

FIG. 3 shows both a block diagram of a closed regulating loop and a block diagram of an open regulating loop. The transfer function of the open regulating loop, which is sometimes also referred to as "open loop transfer function", has poles or pole frequencies. The term pole frequency fp in regulation technology quite generally defines the limiting frequency of a low-pass transfer function of the type 1/(1+s/p) at which an attenuation by 3 dB and a phase postrotation through 45 degrees take place. A further important term in this connection is the term "transition frequency". The term transition frequency ft in voltage regulating technology denotes the 0 dB loading frequency of a transfer function. At the transition frequency ft, the magnitude of signals is not amplified or attenuated. In the English literature, the transition frequency is also referred to as "unity gain frequency (EGF)". For further mathematical-physical details of voltage regulation technology, reference is once again expressly made to the article already mentioned above: "Optimized Frequency-Shaping Circuit Topologies for LDO's" by G. A. Rincon-Mora and P. E. Allen in IEEE TRANSACTIONS ON CIRCUITS AND SYSTEMS-II: ANALOG AND DIGITAL SIGNAL PROCESSING, Vol. 45 (1998), No. 6, pp. 703 to 708.

Poles in the open loop transfer function are as follows:

The regulating amplifier 1 has a dominant pole fp0, the frequency of which can be positioned within specific limits, there being a dependence on the input capacitance of the regulating transistor Q and the permissible current consumption of the regulating amplifier 1.

The regulating transistor Q in conjunction with the load resistor RL and the load capacitance (buffer capacitance) CL supplies a variable pole fp1, the position of which may vary by a plurality of decades in a load-dependent manner. Parasitic poles of the regulating amplifier 1 (fp2 and others) lie in the frequency range>>1 MHz.

The transfer function of the open regulating loop in the s domain reads $$L(s) = \frac{A0}{(1 + s/sp0)(1 + s/spl)(1 + s/sp2)}$$

In this case, the pole of the regulating amplifier 1 is sp0. The following holds true for the load pole sp1:

$$Sp1 \sim \frac{1}{CL \cdot RLtot}$$

where, disregarding the output resistance of the regulating transistor Q.

$$RLtot \sim (RL \| (R1+R2)).$$

In this case, sp2 designates the parasitic pole and the expression (||) designates the resistance brought about by a parallel connection of the resistances specified on both sides of the symbol ||.

The following furthermore hold true:

$$sp = 2\pi \cdot fp$$

$$sz = 2\pi \cdot fz$$

(fp-pole frequency, fz-frequency at which the transfer function has a zero)

The high DC voltage gain A0 in conjunction with a plurality of poles has the effect that the phase of the open loop transfer function may be shifted by 180° or more upon reaching the transition frequency ft. This is illustrated in FIG. 4 with the curve for the incorrect frequency response.

To summarize, then, a stability problem results to the effect that, due to the influence of a plurality of poles fp0, fp1 and fp2 in conjunction with the high gain A0, the phase margin of the open regulating loop can reach impermissible values around 0°.

The prior art discloses various solution approaches for overcoming this stability problem by frequency response correction, all the known solution approaches having specific disadvantages.

It is quite generally the aim of frequency response correction to achieve a phase margin of the open regulating loop of>45°.

One solution approach according to the prior art consists in using an integrating regulating amplifier. In this case, the transition frequency ft of the system is positioned far below the region of effect of the poles fp and fp2 by realizing a very low fp0. However, slow regulation is disadvantageous in this case. Large integrated capacitances are necessary in order to achieve the low fp0.

Another solution approach from the prior art uses a regulating amplifier with a large bandwidth. Here fp0 is realized such that it is very much greater than ft. However, the high current consumption of the regulating amplifier is disadvantageous in this case. At a high transition frequency of the system, parasitic poles such as fp2 may further impair the phase margin.

A further solution approach that is already known per se from the prior art is the realization of zero in the open loop transfer function. As illustrated in FIG. 4, a zero at the frequency fz1 in the open loop transfer function L(s) cancels the phase rotation of a pole. fz1 is expediently chosen to be less than ft.

The prior art discloses various possibilities for realizing a zero in the open loop transfer function. Thus, a zero can be generated by the voltage regulator being connected up externally to passive components. However, the high costs of the external components are disadvantageous in this case.

Furthermore, it is possible to generate a zero in the open loop transfer function by means of integrated active filters. However, this disadvantageously requires an additional current consumption.

The possibility of generating a zero by means of so-called "feedforward" techniques which is furthermore known from the prior art has the disadvantage of circuit side effects that are difficult to estimate.

According to a further variant which is already known and which forms the prior art of the generic type with regard to the invention, the zero in the open loop transfer function is realized by introducing an internal series resistor into the load circuit of the voltage regulator. A circuit which falls under the prior art forming the generic type for the invention is shown in FIG. 5.

The voltage regulator 13 in accordance with FIG. 5 has a regulating amplifier 1. The latter has two inputs 3, 4 and an output 5. Furthermore, the voltage regulator 13 according to FIG. 5 has a controlled current source Q and a voltage regulator output 6 for providing a regulated output voltage Uout. The controlled current source Q may be e.g. a transistor (FET or bipolar transistor).

The first input 3 and the regulating amplifier 1 is connected to a reference voltage source Uref. The second input 4 of the regulating amplifier 1 is connected to an electrical feedback path which leads outside the regulating amplifier 1 from the output 5 of the regulating amplifier 1 via the controlled current source Q to the second input 4 of the regulating amplifier 1. Between the controlled current source Q and the second input 4 of the regulating amplifier 1, at the node designated by "A" in FIG. 5, an electrical output path branches from the electrical feedback path to the voltage regulator output 6. In the electrical output path, an internal nonreactive resistor RZ is arranged in series between the branching A and the voltage regulator output 6. Said internal nonreactive resistor RZ is also occasionally referred to as "series resistor in the load circuit".

The voltage regulator 13 illustrated in FIG. 5 furthermore has a voltage divider circuit R1, R2, which, however, is optional and, like all the circuit details described with reference to FIG. 5 with the exception of the internal nonreactive resistor RZ, does not belong to the obligatory features forming the generic type with regard to the present invention.

In conjunction with the external buffer capacitance CL, which may also be a purely parasitic capacitance, the introduction of the series resistor RZ into the load circuit effects a zero in the open regulating loop.

$$fz=CL\cdot RZ/(2\pi)$$

this results in $$L(s)=\frac{A0\cdot(1+s/sz0)}{1+s/sp0)(1+s/sp1)(1+s/sp2)}.$$

Through a suitable choice of fz, a sufficient phase margin can be achieved for a large load resistance range.

The advantages of the previously described type of frequency compensation are that parasitic impedances ESR (ESR=equivalent series resistance) in the external load circuit (see FIG. 6) can only slightly influence the regulated system since the internal nonreactive resistor RZ dominates over said parasitic impedances ESR in the load circuit. A minimum ESR for an external capacitance is not necessary in the case of the previously described type of frequency compensation since an internal resistance (internal nonreactive resistor RZ) is guaranteed. Furthermore, for realizing the zero, a passive component suffices, namely the internal nonreactive resistor RZ mentioned, which can even be integrated and thus has a current-saving effect in comparison with the other solutions known from the prior art. Moreover, the frequency fz at which the transfer function has a zero is readily reproducible and depends only on the size of the internal nonreactive resistor RZ mentioned and the buffer capacitance CL, but not on transistor parameters and operating voltages.

Despite these indeed highly significant advantages, the last-described solution to the stability problem according to the prior art has the disadvantage that an offset voltage Uf depends on the load current I due to a voltage drop at the internal nonreactive resistor RZ mentioned, where Uf=I·RZ. Furthermore, the integration of the internal nonreactive resistor RZ is problematic since the latter must have a very low value and at the same time a high current-carrying capacity.

SUMMARY OF THE INVENTION

Therefore, the invention is based on the object of providing, proceeding from the voltage regulator of the generic type, a voltage regulator which overcomes the above-described offset voltage problem with stability remaining good and with a sufficient phase margin.

According to the invention, this object can be achieved by means of a voltage regulator comprising a voltage regulator output for providing a regulated output voltage, an internal electrical regulation feedback path, and an internal nonreactive resistor, which is arranged in an internal load branch of the voltage regulator in such a way that it is located electrically in series with an external load to be connected to the voltage regulator output, wherein the voltage regulator is set up in such a way that its internal electrical regulation feedback path is tapped both at a first point upstream of the internal nonreactive resistor and at a second point downstream of the internal nonreactive resistor, the second point being located between the internal nonreactive resistor and the voltage regulator output, and for frequencies above a predetermined frequency the regulation is essentially effective directly via the first point, while for frequencies below the predetermined frequency, the regulation is essentially effected via the path first point-internal nonreactive resistor-second point.

The voltage regulator may further comprise a regulating amplifier, which has two inputs and an output, and a controlled current source, wherein the first input of the regulating amplifier serves for connection to a reference voltage source, the second input of the regulating amplifier is connected to the electrical feedback path which leads outside the regulating amplifier from the output of the regulating amplifier via the controlled current source to the second input of the regulating amplifier, between the controlled current source and the second input of the regulating amplifier, an electrical output path branches from the electrical feedback path to the voltage regulator output, in which the internal nonreactive resistor is arranged in series between the branching and the voltage regulator output, the voltage regulator furthermore has a frequency diplexer, which has two inputs and an output, the frequency diplexer is connected into the electrical feedback path in series by its first input and its output in such a way that its first input points in the direction of the branching of the electrical output path and its output points in the direction of the second input of the regulating amplifier, the second input of the frequency diplexer is connected to a further electrical path which branches from the electrical output path between the internal nonreactive resistor and the voltage regulator output, and the frequency diplexer is designed in such a way that the frequency diplexer transmits signals having frequencies above a predetermined diplexer frequency from its first input to its output, the frequency diplexer transmits signals having frequencies below the predetermined diplexer frequency from its second input to its output, and the respective other internal path of the frequency diplexer is essentially blocked for signals from the respective other frequency range.

The maximum coupling factor of the frequency diplexer from its first input to its output can be greater than or equal to the maximum coupling factor from its second input to its output. The regulating amplifier can be an operational amplifier. The further electrical path may have a voltage divider circuit and the second input of the frequency diplexer can be connected to the further electrical path between resistors of the voltage divider circuit. The frequency diplexer can be a passive RC filter. The frequency diplexer may have a voltage divider circuit. The internal nonreactive resistor can be embodied as a parallel circuit of N individual resistors, where N is greater than 1. The controlled current source can be embodied as a parallel circuit of N individual controlled current sources, where N is greater than 1. The internal nonreactive resistor can be embodied as a parallel circuit of N individual resistors, where N is greater than 1, the controlled current source can be embodied as a parallel circuit of N individual controlled current sources, where N is greater than 1, each of the N individual controlled current sources can be in each case electrically connected directly to its respectively associated individual resistor from the set of N individual resistors, thereby producing N direct electrical connections between the N individual controlled current sources and the N individual resistors, the N direct electrical connections may not be electrically interconnected, and the first input of the frequency diplexer can be directly connected only to one of the N direct electrical connections. The controlled current source or at least one of the N individual controlled current sources can be a transistor. The transistor can be a FET or a bipolar transistor. An internal capacitance can be located electrically in parallel with the external load to be connected to the voltage regulator output and can be arranged in an electrical branch which branches in the direction of ground between the internal nonreactive resistor and the voltage regulator output. The dimensions of its components can be chosen such that a frequency at which its transfer function has a zero is less than its transition frequency. The voltage can be embodied as an integrated circuit.

The offset voltage problem is overcome by offset voltage compensation in the case of the voltage regulator according to the invention. For this purpose, the regulation is tapped both upstream and downstream of the internal nonreactive resistor and the voltage regulator is designed in such a way that different regulating paths act in different frequency ranges. Expressed concretely in the terms of claim 1 this means: the offset voltage is corrected for the frequency range below the predetermined frequency by tapping at the second point, that is to say between the internal nonreactive resistor and the voltage regulator output, and thus cannot be measured at the external load. For the frequency range above the predetermined frequency, regulation is effected by tapping at the first point, which is separated from the second point by the internal nonreactive resistor, as a result of which the zero becomes effective at fz and ensures the phase prerotation (frequency response correction).

In one preferred embodiment of the voltage regulator, the offset voltage compensation is realized by means of a frequency diplexer 2 to the feedback path.

In one preferred embodiment of the voltage regulator, the coupling factors of the frequency diplexer 2 are chosen such that no additional pole can arise around the diplexer frequency fw.

An especially preferred embodiment of the voltage regulator is suitable in particular for the embodiment as an integrated circuit since the N individual resistors, in each case viewed individually, only have to have a low current-carrying capacity of I/N.

By virtue of the otherwise purely external buffer capacitance being incorporated into the voltage regulator itself in the manner implemented in a particularly preferred embodiment of the voltage regulator, the frequency at which the transfer function has a zero can be influenced in a more targeted manner.

In a likewise particularly preferred embodiment of the voltage regulator according to the invention, the internal nonreactive resistor RZ is also embodied as an integrated component, which is particularly cost-effective.

BRIEF DESCRIPTION OF THE DRAWINGS

Exemplary embodiments of the voltage regulator according to the invention are explained below with reference to figures, in which.

DETAILED DESCRIPTION OF THE PREFERRED EMBODIMENTS

Figure 1:
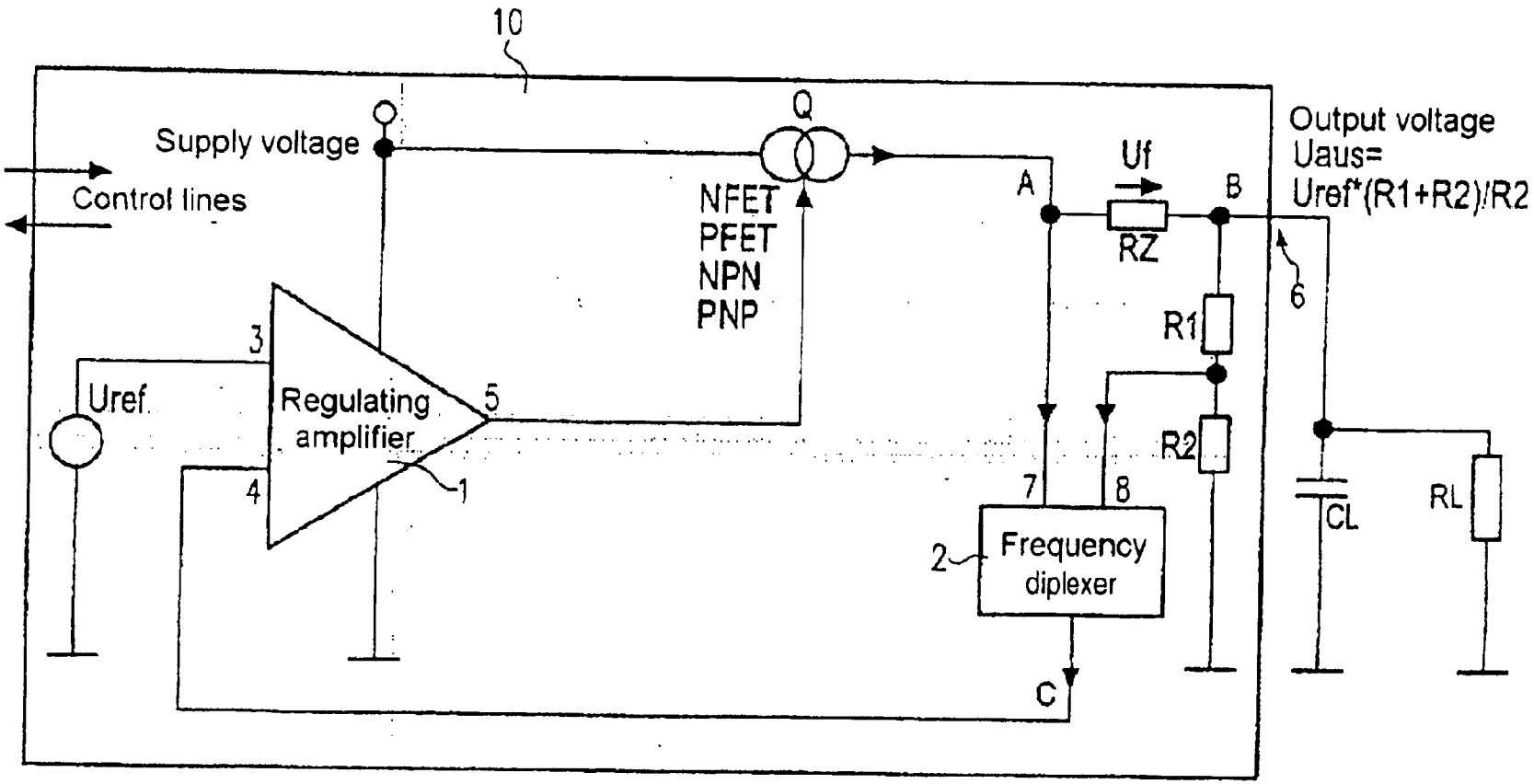
FIG. 1 shows a schematic circuit diagram of a first exemplary embodiment of a voltage regulator according to the invention.
Figure 2:
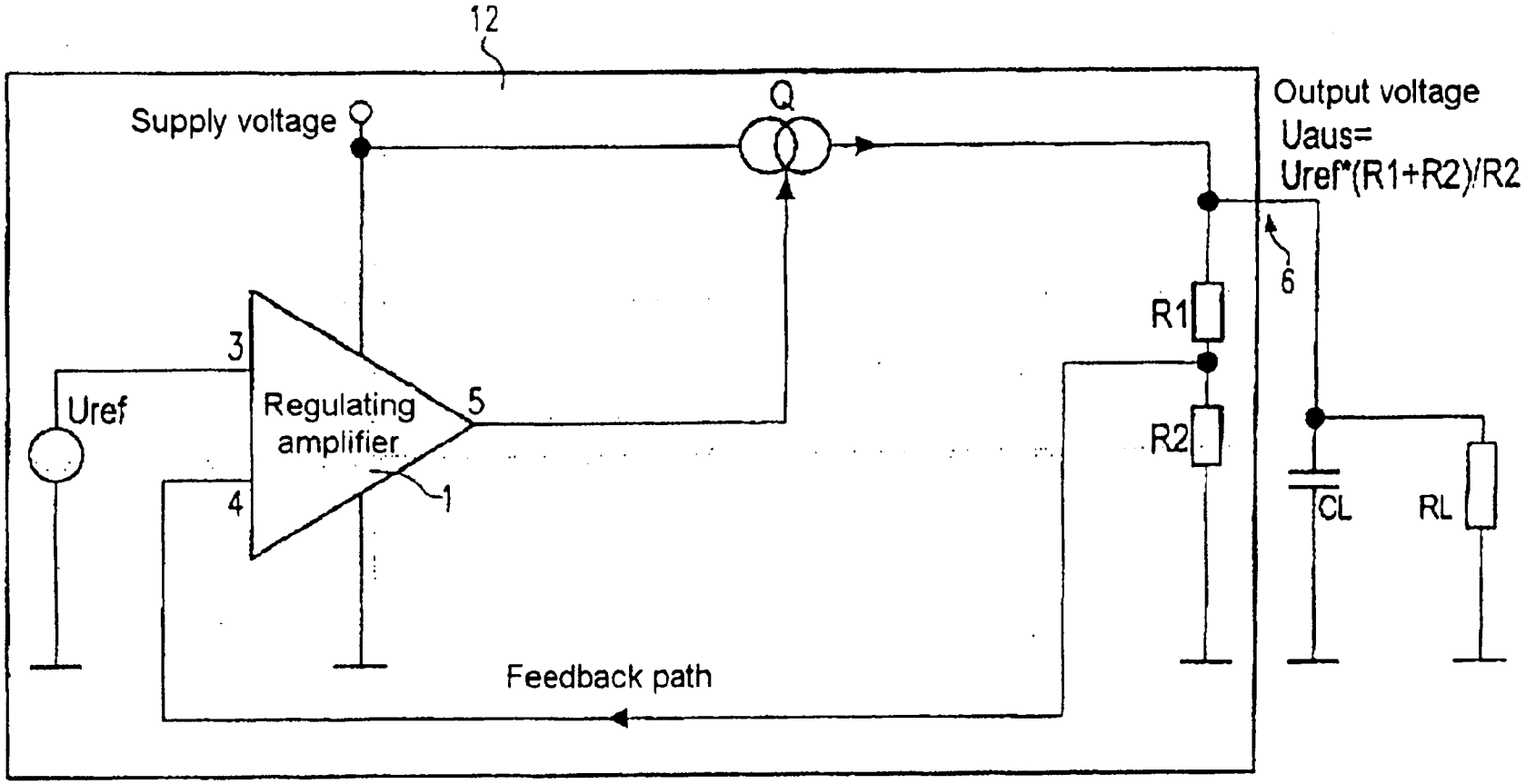
FIG. 2 generally shows a diagram of a voltage regulator which is known from the prior art and has no frequency response correction.
Figure 3:
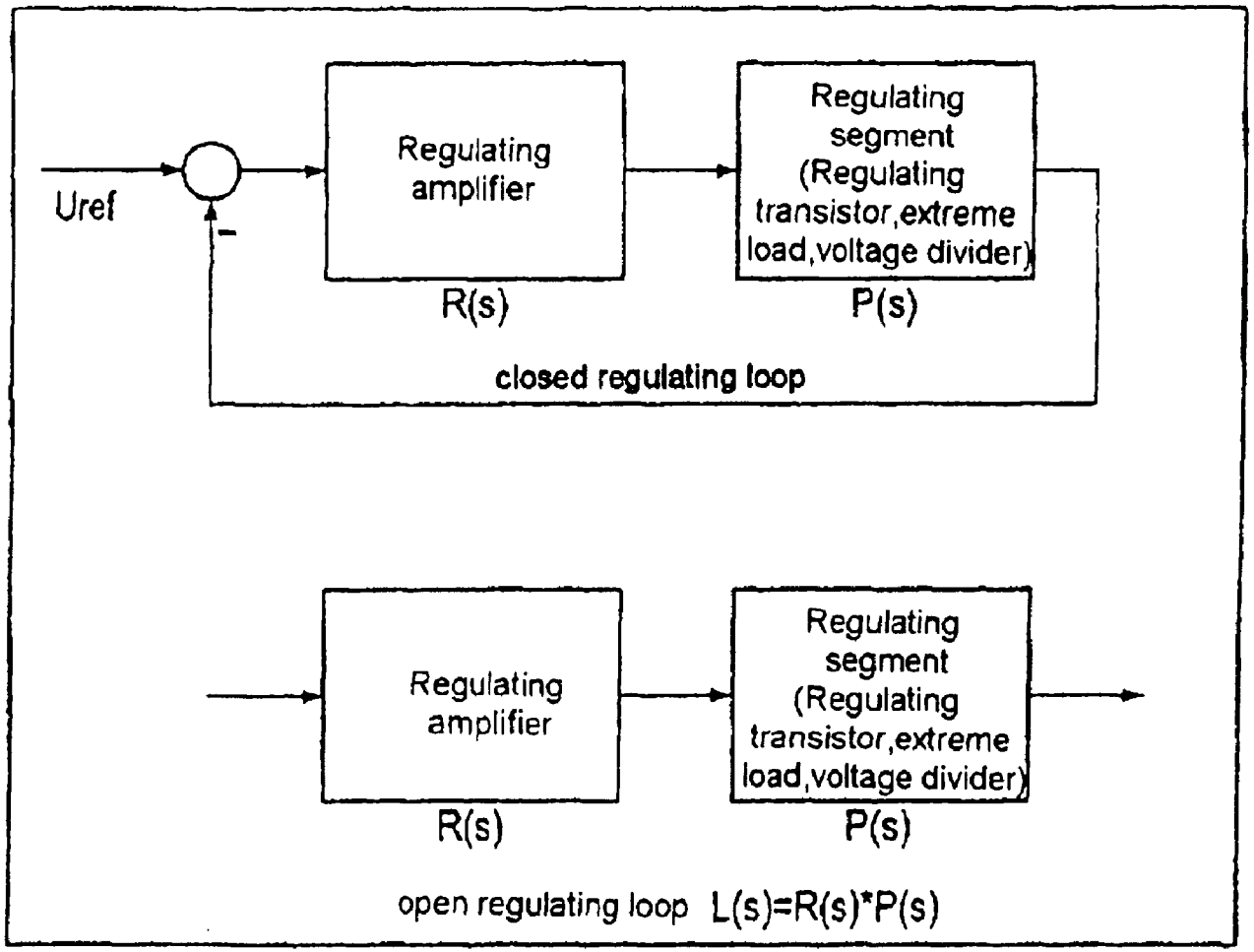
FIG. 3 shows block diagrams of a closed regulating loop and of an open regulating loop.

A first exemplary embodiment of a voltage regulator 10 according to the invention, which is illustrated in FIG. 1, comprises a regulating amplifier 1, which is formed as an operational amplifier and has two inputs 3, 4 and an output 5, a controlled current source Q and a voltage regulator output 6 for providing a regulated output voltage Uout. In the present exemplary embodiment, the controlled current source Q, which is only illustrated schematically in FIG. 1, is a transistor, e.g. an NFET, PFET, npn bipolar transistor or pnp bipolar transistor.

The first input 3 of the regulating amplifier 1 is connected to a reference voltage source Uref. The second input 4 of the regulating amplifier 1 is connected to an electrical feedback path, which leads outside the regulating amplifier 1 from the output 5 of the regulating amplifier 1 via the transistor Q to the second input 4 of the regulating amplifier 1. Between the transistor Q and the second input 4 of the regulating amplifier 1, at the node designated by "A" in FIG. 1, an electrical output path branches from the electrical feedback path to the voltage regulator output 6. In said electrical output path, a nonreactive resistor RZ, which is designated as "internal nonreactive resistor RZ" below, is arranged in series between the branching A and the voltage regulator output 6.

Furthermore, the illustrated exemplary embodiment of the voltage regulator 10 according to the invention has a frequency diplexer 2 having two inputs 7, 8 and an output C. The frequency diplexer 2 is connected into the electrical feedback path in series with its first input 7 and its output C in such a way that its first input 7 points in the direction of the branching A of the electrical output path and its output C points in the direction of the second input 4 of the regulating amplifier 1. The second input 8 of the frequency diplexer 2 is connected to a fturther electrical path which branches from the electrical output path at point B (see FIG. 1) between the internal nonreactive resistor RZ and the voltage regulator output 6. In this case, in the exemplary embodiment of the voltage regulator 10 according to the invention of FIG. 1, the further electrical path mentioned has a voltage divider circuit comprising two nonreactive resistors R1, R2. The second input 8 of the frequency diplexer 2 is connected to the further electrical path between the two resistors R1, R2 of the voltage divider circuit.

The frequency diplexer 2 is designed in such a way that it transmits signals having frequencies above a predetermined diplexer frequency fw from its first input 7 to its output C. Signals having frequencies below the predetermined diplexer frequency fw are transmitted from the second input 8 of the frequency diplexer 2 to its output C. The respective other internal path of the frequency diplexer 2 is essentially blocked for signals from the respective other frequency range. Relative to the node designation chosen in FIG. 1, this means that the frequency diplexer 2 transmits signals having frequencies<<fw from B to C and signals having frequencies>>fw from A to C.

The method of operation of the frequency diplexer 2 in the present circuit is as follows: the offset voltage Uf is corrected for the frequency range<<fw by tapping at point B and thus cannot be measured at the load. For the frequency range>>fw, regulation is effected by tapping at point A, as a result of which the zero becomes effective at fz and ensures the phase prerotation (frequency response correction). However, a prerequisite for this is that fz<ft is chosen.

In the exemplary embodiment of the voltage regulator according to the invention of FIG. 1, the maximum coupling factor of the frequency diplexer 2 from A→C is chosen to be greater than or at least equal to the maximum coupling factor of the frequency diplexer 2 from B→C in order not to permit an additional pole to arise around fw.

In the present exemplary embodiment, the frequency diplexer 2 is realized as a passive RC filter in terms of circuitry.

Figure 6:
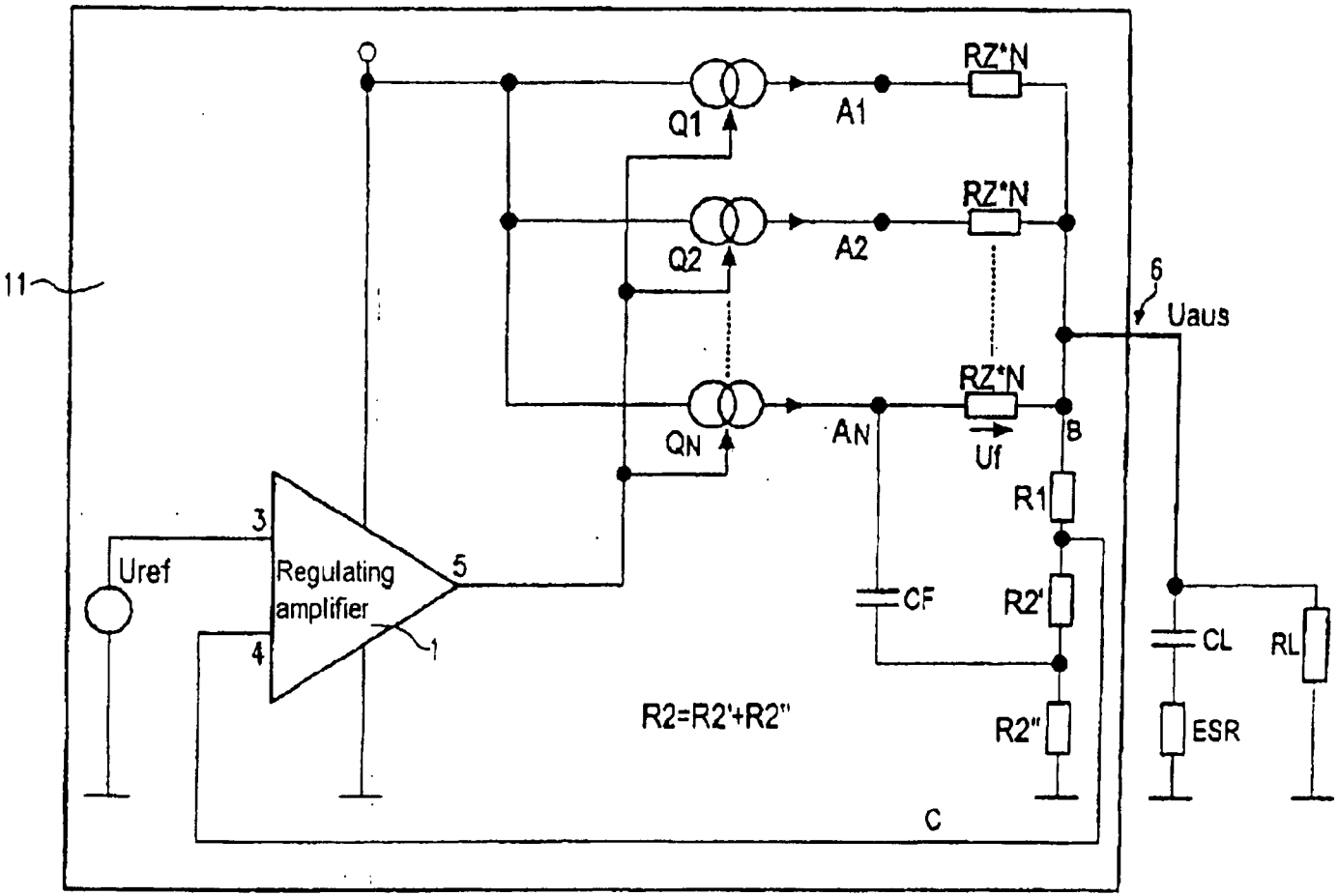
FIG. 6 schematically shows a circuit diagram of a second exemplary embodiment of the voltage regulator according to the invention.

FIG. 6 shows a second exemplary embodiment of the voltage regulator 11 according to the invention, in which the voltage regulator 11 is embodied as an integrated circuit. In the exemplary embodiment of the voltage regulator 11 according to the invention of FIG. 6, the internal nonreactive resistor RZ mentioned is embodied together with the regulating transistor Q as a parallel circuit of N individual elements where R=RZ·N (N>1), which intrinsically only have to have a low current-carrying capacity of I/N.

The dimensioning of the frequency compensation in the exemplary embodiment illustrated in FIG. 6 is as follows: In the exemplary embodiment described, the integrated voltage regulator 11 is intended to supply an output voltage Uout of 1.5 V at a maximum current of I=0.1 A. The sum of the voltage divider resistors R1+R2 amounts to 150 kΩ. Due to the dictates of construction, fp0 of the regulating amplifier 1 shall be 100 kHz. The regulated supply voltage is backed up with an external capacitance CL=1 μF. In a further exemplary embodiment of the voltage regulator according to the invention, this capacitive backing-up of the regulated supply voltage is even effected by a capacitance which is arranged internally in the voltage regulator and is connected into an electrical branch in parallel with the load to be connected to the voltage regulator output 6, said branch branching in the direction of ground between the voltage regulator output 6 and the internal nonreactive resistor RZ.

The estimation of the pole and zero frequencies is as follows:

RLtot is a minimum of ≈1.5 V/0.1 A=15 Ω and a maximum of 150 kΩ. fp1 thus lies in the range of≈1 Hz to 10 kHz.

The internal nonreactive resistor RZ is chosen to be 0.32 Ω. The offset voltage drop at RZ given maximum current is a maximum of 0.32 Ω·0.1 A=0.032 V.

Given a capacitance of CL=1 μF and a resistance RZ=0.32 Ω, the desired zero is at $fz=1/(2\cdot\pi\cdot 0.32\ \Omega\cdot 1\ \mu F)\approx 500$ kHz.

Figure 4:
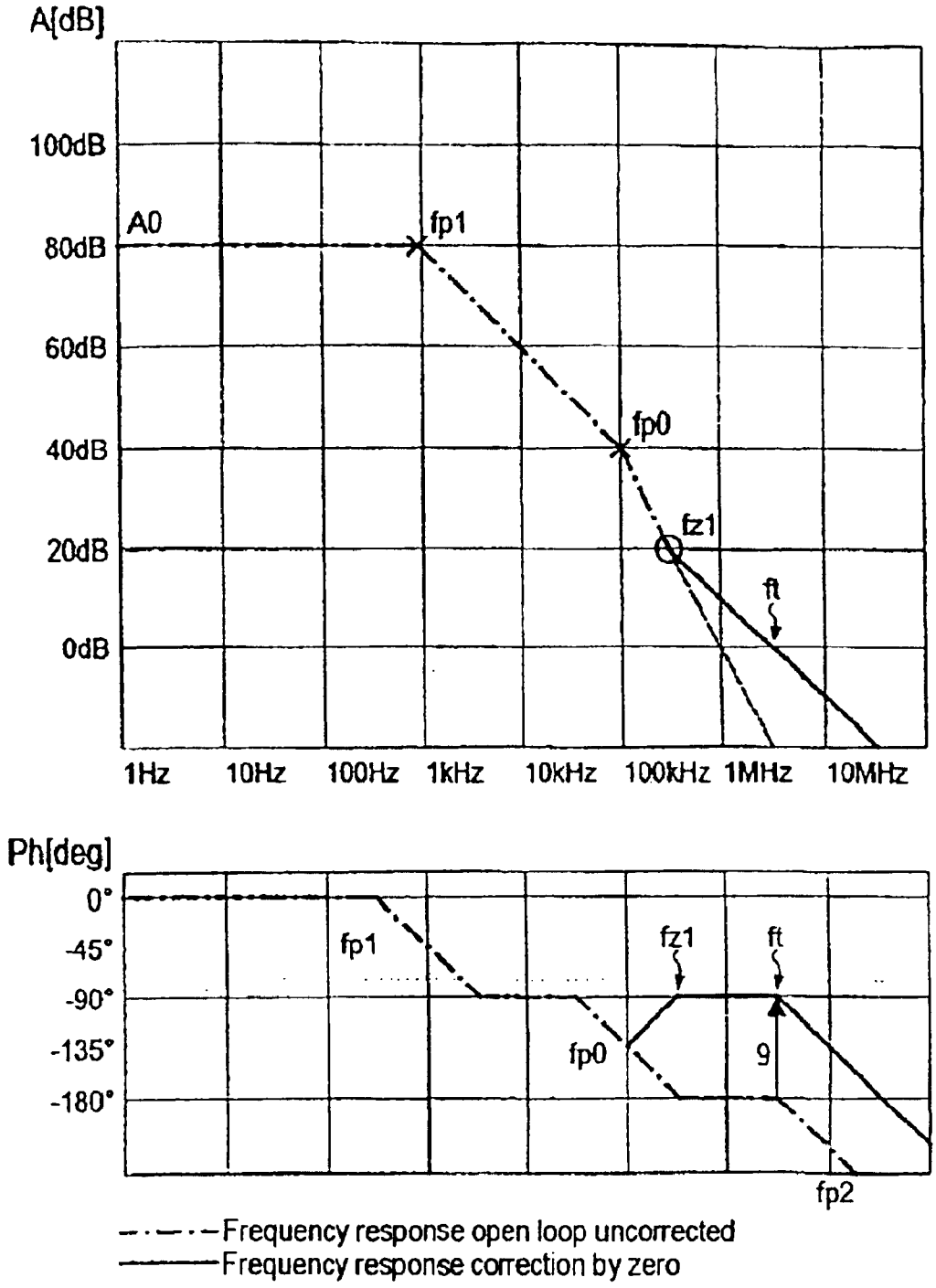
FIG. 4 shows examples of frequency responses (gain, phase) of a voltage regulator without and with frequency response correction.
Figure 5:
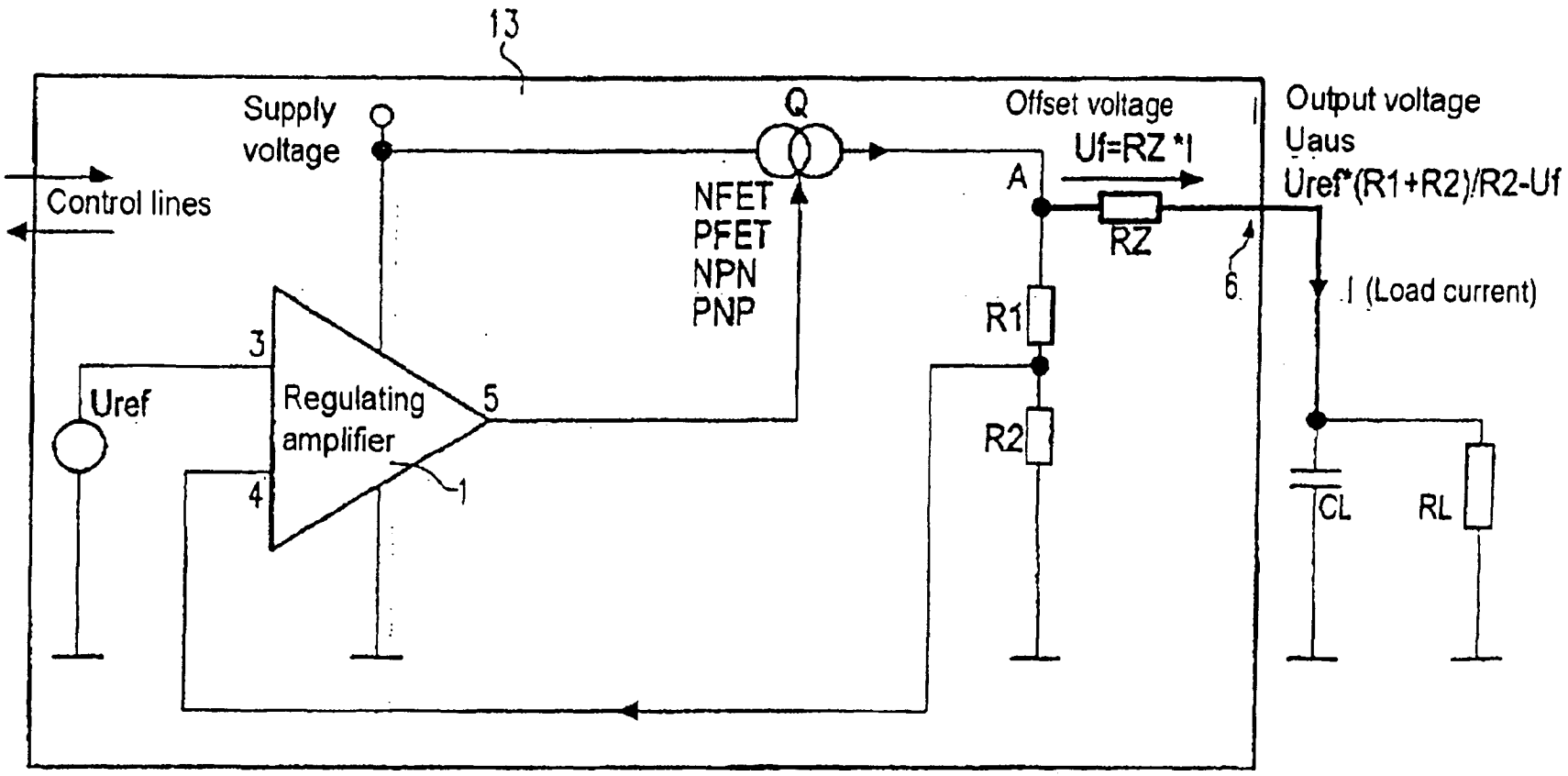
FIG. 5 generally shows a diagram of a voltage regulator which is known from the prior art and has frequency response correction by a series resistor being connected into the load circuit.

The associated frequency response is illustrated in FIG. 4 (curve "frequency response correction by zero"). The frequency response has a sufficient phase margin 9 in any permissible load case. FIG. 4 corresponds to 10% of the maximum load (fp1=1 kHz). Consideration of the phase response in FIG. 4 reveals that even with a minimum load (fp1=1 Hz) and with full load (fp1=10 kHz), the phase margin would not fall below 45°.

If the exemplary embodiment 11 illustrated in FIG. 6 is compared with the exemplary embodiment 10 of the voltage regulator according to the invention which is illustrated in FIG. 1, then it can be established that the resistor R2 from the voltage divider circuit according to FIG. 1 is divided into two parts R2' and R2" in the exemplary embodiment of FIG. 6.

In the exemplary embodiment of the voltage regulator 11 according to the invention which is illustrated in FIG. 6, the frequency diplexer 2 is essentially formed from R1, R2', R2" and CF. The following holds true to an approximation: $fw \approx 1/(2\cdot\pi\cdot CF\cdot(R2'' \| (R1+R2')))$.

Like all the other components in the voltage regulator 11 according to FIG. 6, the capacitance CF is also integrated on the chip. It is possible to realize the capacitance CF as gate capacitance or junction capacitance, since sufficient voltage is present in the operating case.

A special feature of the exemplary embodiment of the voltage regulator 11 according to the invention which is illustrated in FIG. 6 is that it is not necessary for the points A1, A2, . . . , AN (see FIG. 6) to be directly electrically connected. Dynamically and statically, the points A1, A2, . . . , AN are at the same potential since the loading of the point AN by CF is negligible.

As is already the case in the exemplary embodiment 10 of FIG. 1, it is also the case in the exemplary embodiment of the voltage regulator 11 according to the invention according to FIG. 6 that the controlled current sources Q1, Q2, . . . , QN are formed as transistors. A particular advantage of the exemplary embodiment of the voltage regulator 11 according to the invention according to FIG. 6 is that each individual transistor Q1, Q2, . . . , QN is provided with a series resistor of magnitude RZ·N, which leads to an increased ESD protection. With the use of bipolar transistors for Q1, Q2, . . . , QN, the provision of the series resistors RZ·N is additionally particularly advantageous for their thermal coupling.

In terms of its frequency function, the frequency diplexer (R1, R2', R2", CF) in the circuit of the exemplary embodiment 11 according to FIG. 6 is in principle designed in the same way as the frequency diplexer 2 in the circuit of the exemplary embodiment 10 according to FIG. 1. In other words, the frequency diplexer (R1, R2', R2", CF) transmits signals having frequencies<<fw from B to C and signals having frequencies>>fw from AN to C. Moreover, it is also the case in the exemplary embodiment of the voltage regulator 11 according to the invention of FIG. 6 that the maximum coupling factor of the frequency diplexer from AN→C is chosen to be greater than or at least equal to the maximum coupling factor of the frequency diplexer from B→C in order not to permit an additional pole to arise around fw.

I claim:

1. A voltage regulator comprising:

a voltage regulator output for providing a regulated output voltage, internal electrical regulation feedback path, and an internal nonreactive resistor, which is arranged in an internal load branch of the voltage regulator in such a way that it is located electrically in series with an external load to be connected to the voltage regulator output, wherein the voltage regulator is set up in such a way that its internal electrical regulation feedback path is tapped both at a first point upstream of the internal nonreactive resistor and at a second point downstream of the internal nonreactive resistor, the second point being located between the internal nonreactive resistor and the voltage regulator output, and for frequencies above a predetermined frequency the regulation is essentially effective directly via the first point, while for frequencies below the predetermined frequency, the regulation is essentially effected via the path first point-internal nonreactive resistor-second point.

2. The voltage regulator as claimed in claim 1, comprising a regulating amplifier, which has two inputs and an output, and a controlled current source, wherein the first input of the regulating amplifier serves for connection to a reference voltage source, the second input of the regulating amplifier is connected to the electrical feedback path which leads outside the regulating amplifier from the output of the regulating amplifier via the controlled current source to the second input of the regulating amplifier, between the controlled current source and the second input of the regulating amplifier, an electrical output path branches from the electrical feedback path to the voltage regulator output, in which the internal nonreactive resistor is arranged in series between the branching and the voltage regulator output, the voltage regulator furthermore has a frequency diplexer, which has two inputs and an output, the frequency diplexer is connected into the electrical feedback path in series by its first input and its output in such a way that its first input points in the direction of the branching of the electrical output path and its output points in the direction of the second input of the regulating amplifier, the second input of the frequency diplexer is connected to a further electrical path which branches from the electrical output path between the internal nonreactive resistor and the voltage regulator output, and the frequency diplexer is designed in such a way that the frequency diplexer transmits signals having frequencies above a predetermined diplexer frequency from its first input to its output, the frequency diplexer transmits signals having frequencies below the predetermined diplexer frequency from its second input to its output, and the respective other internal path of the frequency diplexer is essentially blocked for signals from the respective other frequency range.

3. The voltage regulator as claimed in claim 2, wherein the maximum coupling factor of the frequency diplexer from its first input to its output is greater than or equal to the maximum coupling factor from its second input to its output.

4. The voltage regulator as claimed in claim 2, wherein the regulating amplifier is an operational amplifier.

5. The voltage regulator as claimed in claim 2, wherein the further electrical path has a voltage divider circuit and the second input of the frequency diplexer is connected to the further electrical path between resistors of the voltage divider circuit.

6. The voltage regulator as claimed in claim 2, wherein the frequency diplexer is a passive RC filter.

7. The voltage regulator as claimed in claim 6, wherein the frequency diplexer has a voltage divider circuit.

8. The voltage regulator as claimed in claim 1, wherein the internal nonreactive resistor is embodied as a parallel circuit of N individual resistors, where N is greater than 1.

9. The voltage regulator as claimed in claim 2, wherein the controlled current source is embodied as a parallel circuit of N individual controlled current sources, where N is greater than 1.

10. The voltage regulator as claimed in claim 1, wherein the internal nonreactive resistor is embodied as a parallel circuit of N individual resistors, where N is greater than 1, the controlled current source is embodied as a parallel circuit of N individual controlled current sources, where N is greater than 1, each of the N individual controlled current sources is in each case electrically connected directly to its respectively associated individual resistor from the set of N individual resistors, thereby producing N direct electrical connections between the N individual controlled current sources and the N individual resistors, the N direct electrical connections are not electrically interconnected, and the first input of the frequency diplexer is directly connected only to one of the N direct electrical connections.

11. The voltage regulator as claimed in claim 1, wherein the controlled current source or at least one of the N individual controlled current sources is a transistor.

12. The voltage regulator as claimed in claim 11, wherein the transistor is a FET or a bipolar transistor.

13. The voltage regulator as claimed in claim 1, comprising an internal capacitance which is located electrically in parallel with the external load to be connected to the voltage regulator output and is arranged in an electrical branch which branches in the direction of ground between the internal nonreactive resistor and the voltage regulator output.

14. The voltage regulator as claimed in claim 1, wherein the dimensions of its components are chosen such that a frequency at which its transfer function has a zero is less than its transition frequency.

15. The voltage regulator as claimed in claim 1, wherein it is embodied as an integrated circuit.

* * * * *

UNITED STATES PATENT AND TRADEMARK OFFICE

CERTIFICATE OF CORRECTION

PATENT NO. : 6,841,978 B2
DATED : January 11, 2005
INVENTOR(S) : Bernhard Schaffer It is certified that error appears in the above-identified patent and that said Letters Patent is hereby corrected as shown below:

Title page,
Item [62], Related U.S. Application Data, should read:
-- Continuation of application No. PCT/DE02/02449, filed on July 4, 2002. --

Signed and Sealed this

Third Day of May, 2005

JON W. DUDAS
*Director of the United States Patent and Trademark Office*